US006510895B1

(12) United States Patent
Koleilat et al.

(10) Patent No.: US 6,510,895 B1
(45) Date of Patent: Jan. 28, 2003

(54) ENERGIZED SEALING CARTRIDGE FOR ANNULUS SEALING BETWEEN TUBULAR WELL COMPONENTS

(75) Inventors: Bashir M. Koleilat, Spring, TX (US); David E. Cain, Houston, TX (US); Qiu Shi Zheng, Spring, TX (US); Michael Hunt, Houston, TX (US)

(73) Assignee: FMC Technologies, Chicago, IL (US)

( * ) Notice: Subject to any disclaimer, the term of this patent is extended or adjusted under 35 U.S.C. 154(b) by 0 days.

(21) Appl. No.: 09/706,958

(22) Filed: Nov. 6, 2000

(51) Int. Cl.[7] ..... E21B 33/04

(52) U.S. Cl. ..... 166/208; 166/217; 277/328; 285/348

(58) Field of Search ..... 166/208, 182, 166/387, 242.1, 217; 277/328, 915; 285/348

(56) References Cited

U.S. PATENT DOCUMENTS

| | | | | |
|---|---|---|---|---|
| 4,131,287 A | * | 12/1978 | Gunderson et al. | 277/191 |
| 4,742,874 A | * | 5/1988 | Gullion | 166/208 X |
| 4,842,061 A | * | 6/1989 | Nobileau | 166/115 |
| 4,932,472 A | * | 6/1990 | Boehm, Jr. | 166/208 |
| 4,960,172 A | * | 10/1990 | Nelson | 166/208 |
| 5,060,724 A | * | 10/1991 | Brammer et al. | 166/208 |
| 5,735,344 A | * | 4/1998 | Duncan | 166/75.41 |

FOREIGN PATENT DOCUMENTS

| | | | |
|---|---|---|---|
| GB | 2193519 A | * | 2/1988 |
| GB | 2251012 A | * | 6/1992 |

* cited by examiner

*Primary Examiner*—Frank S. Tsay
(74) *Attorney, Agent, or Firm*—James L. Jackson; Andrews & Kurth, LLP

(57) ABSTRACT

A mechanically energized annular packoff seal cartridge for metal-to-metal sealing with substantially concentrically arranged tubular members, such as the tubular wellhead housing and well casing of an oil and gas well. A tubular pressure responsive energizing mandrel having downwardly converging frusto-conical seal actuating surfaces is of a dimension for entry into the annulus between the wellhead seal bore and the rough outer surface of the well casing. Elastomer seals are carried by the energizing mandrel and establish sealing of the energizing mandrel with the wellhead housing and well casing A pair of soft metal seal rings are carried by the seal cartridge and are forced radially into metal-to-metal sealing with the wellhead housing and the rough outer surface of the well casing respectively by the double tapered seal actuating surfaces responsive to pressure induced downward force on the energizing mandrel. A locking mandrel and the seal actuating mechanism are restrained against actuating movement during running of the seal cartridge by a running tool by shear pins, thus enabling the cartridge to pass through various well equipment. The shear pin of the locking mandrel is sheared by downward force applied by the running tool to lock the seal cartridge within the wellhead housing. The shear pin of the seal actuating mechanism is sheared, after locking of the cartridge to the wellhead housing, by the force of pressure introduced into the wellhead above the seal cartridge which acts to develop a pressure differential across the elastomer seals of the cartridge.

20 Claims, 4 Drawing Sheets

ENERGIZED SEALING CARTRIDGE FOR ANNULUS SEALING BETWEEN TUBULAR WELL COMPONENTS

BACKGROUND OF THE INVENTION

1. Field of the Invention

The present invention relates generally to sealing mechanisms for sealing between tubular elements such as between a rough casing and the wellhead seal bore of a wellhead assembly. More particularly, the present invention concerns a mechanically energized seal cartridge for metal-to-metal sealing and elastomer sealing between substantially concentrically arranged tubular element for sealing the annulus therebetween.

2. Description of the Prior Art

In the oil and gas industry, and especially in subsea or other underwater well drilling procedures, it is well established practice to employ an annular seal assembly, referred to as a packoff, between adjacent concentric wellhead elements such as the wellhead seal bore and rough well casing or between a wellhead housing and casing hangers that support the casing strings in the well, to pressure seal the annuli between these elements. For many years these packoffs have included elastomeric or other non-metallic annular seal elements that, when energized into tight contact with the opposed wellhead and hanger surfaces, provided the requisite pressure barrier. However, the increasing trend towards drilling deep wells into relatively high pressure strata, and the frequency of encountering hydrogen sulfide or other dangerous or corrosive gases in these wells, has led to development of packoffs with all metal seal elements to establish a metal-to-metal pressure barrier. Although some of the known packoffs with metal-to-metal seals function satisfactorily under certain conditions, there is a growing industry need for such packoffs that can be installed from a remote location without difficulty, that will withstand higher operating pressure and higher corrosive environments than heretofore experienced, and that will maintain the seal throughout wide fluctuations in pressure.

It is often the case that it is desirable to accomplish annulus sealing between the inner, typically smooth wellhead seal bore of a wellhead and the typically rough outer peripheral surface of a section of well casing. Moreover, at times the well casing will be slightly out of round, thus present the requirement that sufficiently high mechanical force be applied during setting of the metal-to-metal annulus seal that the casing is deflected to a cylindrical external configuration in the immediate region of the seal. This is not a practical consideration when elastomer seals are employed or when metal sealing elements lack sufficiently high setting force to accommodate the geometric non-conformity of the well casing. Even further, when the outer peripheral surface of the well casing is rough, which is often the case, metal-to-metal annulus sealing between the tubular elements can be exceedingly difficult due to the lack of sufficiently high setting force of the metal seals for adequate sealing with the rough surface of the casing. Another difficulty of metal-to-metal sealing under these conditions is that the metal sealing elements are typically formed of hard metal, and thus are incapable of deforming into and establishing efficient sealing with the surface pits, fissures and other surface irregularities of the outer peripheral well casing surface. Of course, the well casing can be machined to form a relatively smooth outer peripheral surface to facilitate effective sealing, but the difficulty and expense of machining a portion of a well casing cause machining of the well casing to be a commercially impractical solution to the problem. It is desirable, therefore, to provide a packoff sealing cartridge having the capability for development of efficient sealing force and the provision of efficient sealing materials in a packoff sealing mechanism for development of metal-to-metal sealing of the annuli between the wellhead and well casing, without necessitating machining of the casing.

SUMMARY OF THE INVENTION

It is a principal feature of the present invention to provide a novel mechanically energized annulus sealing cartridge having the capability of accomplishing efficient metal-to-metal sealing between concentric tubular components even when one of the tubular components has a rough peripheral surface in the region where annulus sealing is desired and without necessitating surface preparation of the rough surface to permit metal-to-metal sealing.

Broadly considered, the present invention contemplates the provision of an annulus seal cartridge which is interposed within the annulus between tubular well elements, such as a tubular wellhead having a seal bore and a section of well casing or a casing hanger element and which is activated to establish a metal-to-metal annulus seal even under circumstances where an annular surface to be sealed is quite rough, such as in the case of the outer peripheral surface of a well casing. Additionally, the annulus packoff seal cartridge is provided with an elastomeric sealing system as well as pressure energized metal-to-metal sealing capability to provide for effective control of the sealing capability of the seal cartridge, especially when elevated well pressures are expected to be encountered.

A tubular energizing mandrel for the annulus sealing cartridge is provided with pair of oppositely tapered or double tapered circular internal and external frusto-conical cam surfaces. A pair of circular metal sealing elements or rings composed of a relatively soft and preferably corrosion resistant metal, such as 316 stainless steel or the like, or any other metal material being softer than the metal material of the concentric tubular elements, define circular frusto-conical cam surfaces that are operatively positioned with respect to the double tapered internal and external cam surfaces of the energizing mandrel. Additionally, the energizing mandrel carries metal spring reinforced and enhanced annular elastomeric sealing elements disposed for sealing respectively with the smooth internal sealing surface of the seal bore of the wellhead and with the rough outer peripheral surface of the well casing to thus provide an elastomer annulus bridging seal so that the seal cartridge can be pressure energized to effectuate sealing.

BRIEF DESCRIPTION OF THE DRAWINGS

So that the manner in which the above recited features, advantages and objects of the present invention are attained and can be understood in detail, a more particular description of the invention, briefly summarized above, may be had by reference to the preferred embodiment thereof which is illustrated in the appended drawings, which drawings are incorporated as a part hereof.

It is to be noted however, that the appended drawings illustrate only a typical embodiment of this invention and are therefore not to be considered limiting of its scope, for the invention may admit to other equally effective embodiments.

IN THE DRAWINGS

Figure 1:
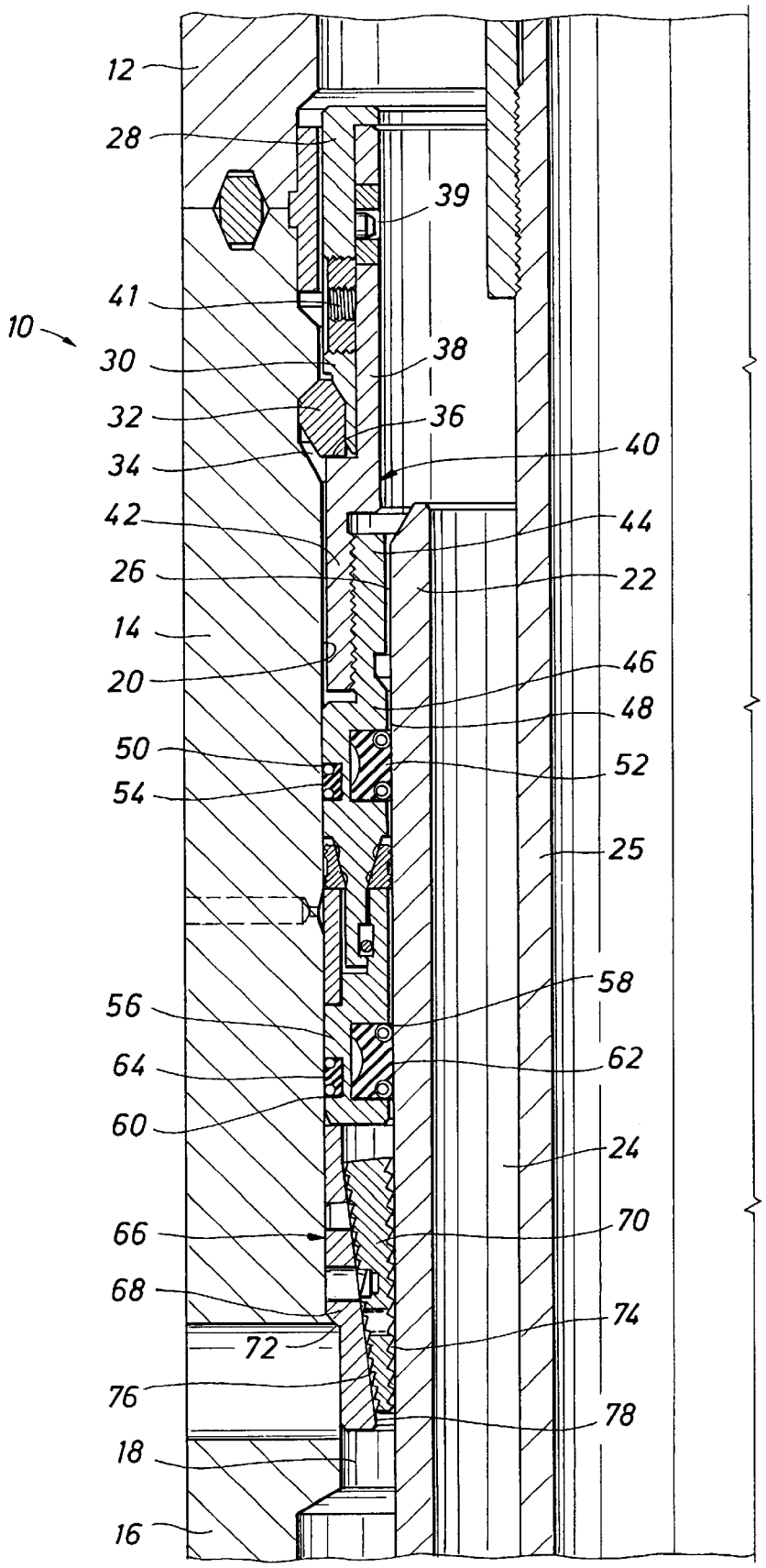
Figure 2:
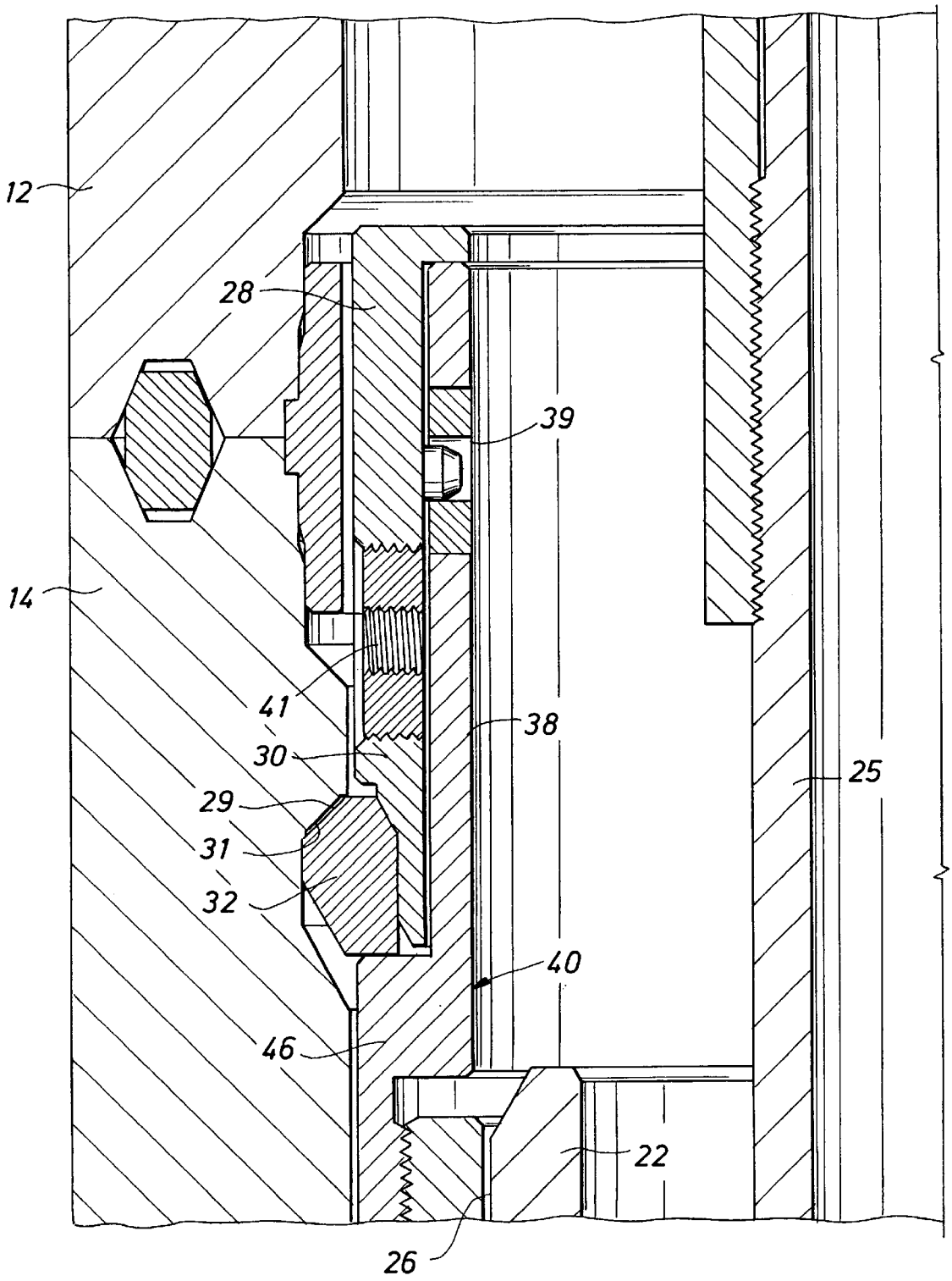
Figure 3:
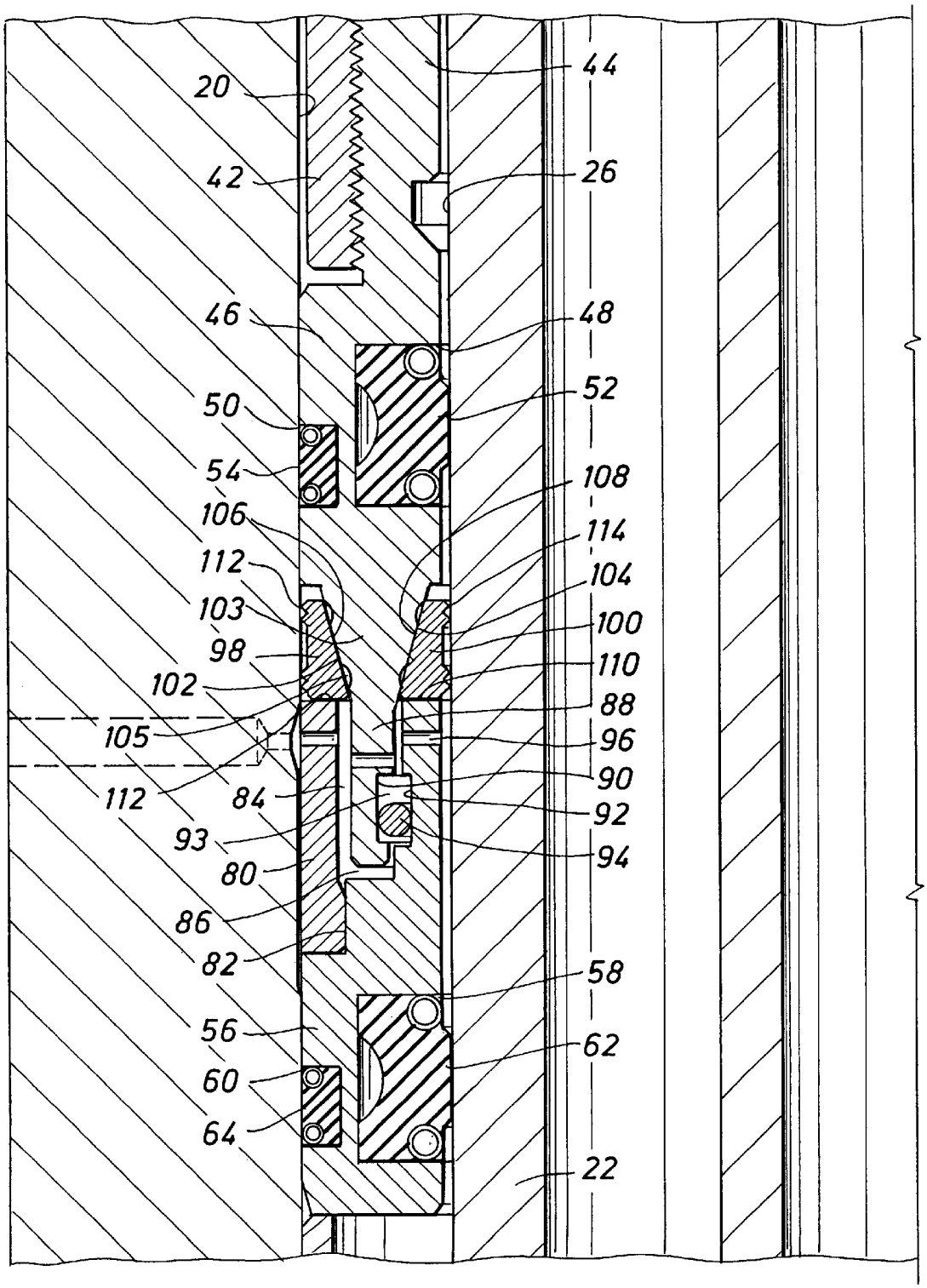
Figure 4:
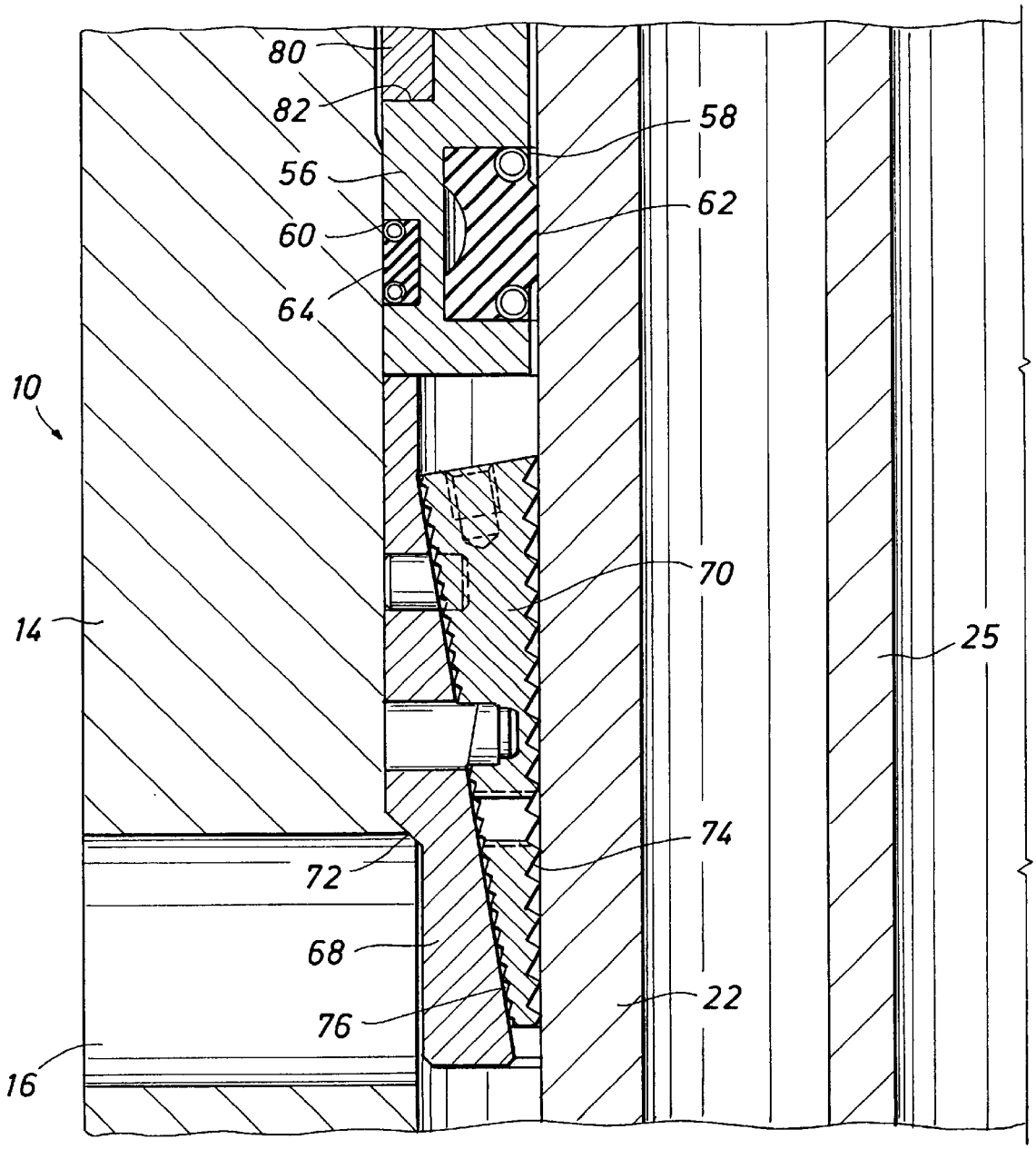

FIG. 1 is a half sectional view of a wellhead assembly embodying a packoff mechanism embodying the principles of the present invention;

FIG. 2 is a fragmentary half sectional illustration showing the upper portion of the wellhead assembly and packoff mechanism in greater detail;

FIG. 3 is a fragmentary half sectional illustration similar to that of FIG. 2 and showing the intermediate portion of the wellhead assembly and packoff mechanism in greater detail;

FIG. 4 is a fragmentary half sectional illustration similar to that of FIGS. 2 and 3 and showing the lower portion of the wellhead assembly and packoff mechanism in greater detail;

DETAILED DESCRIPTION OF PREFERRED EMBODIMENT

Referring now to the drawings and first to FIG. 1, a wellhead assembly of conventional nature is shown generally at 10 and has a tubular wellhead housing 11 having upper, intermediate and lower wellhead housing sections 12, 14 and 16 which are connected or otherwise maintained in sealed assembly. Regarding the wellhead housing, it is not necessary that the specific wellhead arrangement shown in the drawings be employed in order to practice the invention. The tubular wellhead housing defines an internal wellhead seal bore 18 having an internal cylindrical sealing surface 20. The sealing surface 20 is typically machined so that it is smooth so that sealing with it is relatively simple and efficient. Within the wellhead bore is typically supported the upper end of a section of well casing 22 which defines a casing bore 24 and also defines an outer peripheral surface 26 of generally cylindrical configuration. Within the casing bore 24 is typically located a tubing string 25, which may be a drill string when drilling operations are in progress or a production tubing string after a producing well has been completed for production of oil and gas from one or more subsurface formations.

Since it is more convenient and significantly less expensive to provide the well casing in its originally manufactured state rather than to machine sections of it, the outer peripheral surface 26 of the casing is "rough" and thus may have pipe scale present on its surface and the surface may have pits and fissures that are typical with well casing manufacture. Consequently, well casing does not ordinarily provide an efficient external surface against which sealing is easily accomplished. It should also be borne in mind that the well casing may not be perfectly round because of its manufacture and its handling during transport to the site of use. When the well casing is slightly out of round, any sealing system for accomplishing sealing with the casing must be capable of accommodating this anomaly and yet establishing an efficient seal with the casing.

Typically the well casing 22 is located substantially concentrically within the wellhead seal bore 18 as shown in FIG. 1, and being of smaller outer dimension as compared with the internal dimension of the wellhead sealing surface 20, there exists an annulus or annular space between the sealing surface 20 and the outer peripheral surface 26 of the casing. To accommodate well pressure conditions, which can be quite high, it is necessary to establish a seal which essentially bridges the annulus and contains the pressure of the well. This annulus bridging seal must also provide a well pressure safety factor well above maximum expected well pressure for the seal. This type of annulus bridging seal is typically known in the industry as a well pressure packoff or annulus packoff.

Although the annulus seal or packoff of the present invention is discussed herein particularly as it relates to packoff seals in wellhead systems, it should be borne in mind that the packoff sealing mechanism is applicable to any situation where concentrically arranged tubular elements define an annulus which requires sealing. Thus, the present invention may pertain to other industries and other applications within the spirit and scope of the present invention.

Within the tubular wellhead 11, there is provided a locking mandrel 28 having a lower lock actuating element 30 which is profiled for actuation of a locking ring 32 into an internal locking groove 34 of the tubular wellhead element 14. The locking ring 32 is typically in the form of a split ring which is capable of significant expansion and contraction responsive to forces applied thereto by the lock actuating element. The locking ring typically has spring characteristics, thus permitting its contraction to its original condition when the locking force is removed by upward movement of the locking mandrel. The position of the locking ring is in part controlled by its contact with an upwardly facing circular shoulder 36 of the upper tubular section 38 of an energizing mandrel shown generally at 40. It should also be borne in mind that other types of locking elements capable of being actuated to locked and unlocked or release positions responsive to controlling movement of a locking mandrel, may also be employed in connection with the present invention without departing from the spirit and scope thereof.

The upper section 38 of the energizing mandrel 40 is provided with a tubular section extending above the stop shoulder 36 and defining a shear pin receptacle 39 which receives a portion of a shear pin 41 being carried by the locking mandrel 28. During running of the seal cartridge into a well, to retain the components thereof in positions to pass readily through various well equipment, the shear pin will be in place and the lock actuating element thereof will be retracted. This will permit the locking ring 32 to be contracted so that the unit can pass through well equipment such as blowout preventers. It should be borne in mind that any other suitable release mechanism may be employed in place of the shear pin arrangement 39–41, it only being necessary that the locking mandrel be releasably secured to the energizing mandrel during a seal cartridge running operation.

The upper energizing mandrel section 38 defines an internally threaded tubular connecting section 42 which establishes threaded connection with the upper externally threaded section 44 of the lower section 46 of the energizing mandrel. The lower section 46 of the energizing mandrel is provided with internal and external annular seal grooves 48 and 50 respectively within which are located annular elastomeric seal assemblies 52 and 54. These seal assemblies establish sealing respectively with the outer surface 26 of the well casing 22 and with the internal sealing surface 20 of the tubular wellhead 14. Thus, the elastomer seals of the lower section 46 of the energizing mandrel permit the energizing mandrel to function as a tubular piston element so that well pressure in the annulus above the annular seals 52 and 54 acts on the pressure exposed cross section of the energizing mandrel, applying a downward force to the energizing mandrel.

Below the energizing mandrel 40 is located a seal bushing element 56 which serves as a stop element for limiting downward movement of the inner and outer annular metal seal rings. The seal bushing element 56 may have inner and outer annular seal grooves 58 and 60 each having annular elastomeric seal assemblies 62 and 64 contained therein for sealing respectively with the outer surface 26 of the casing 22 and the inner sealing surface 20 which defines the seal bore of the tubular wellhead structure 14. The elastomeric seals 62 and 64 together with the seal bushing 56, provide a sealing bridge for the annulus 18 so that any well pressure below the seal bushing element will be contained. After the seal bushing or stop element 56 has been moved into contact with the casing hanger assembly, shown generally at 66, as shown in FIGS. 1 and 3, further pressure responsive downward movement of the seal bushing element 56 will be prevented by the casing hanger or anchor assembly. The casing hanger or anchor assembly may include an annular wedge element 68 and an annular tapered anchor element 70. The annular wedge element 68 is provided with an annular tapered shoulder surface 72 which seats against a corresponding annular tapered upwardly directed shoulder surface defined with the tubular wellhead section 14. Thus, the annular tapered anchor element 70 provides for anchored support of the casing 22 within the tubular wellhead 14 and also provides an internal stop to prevent downward movement of the seal bushing element 56. The weight of the casing member 22 acts on the tapered anchor 70 and causes the inner peripheral teeth 74 of the anchor to restrain downward movement of the casing. External teeth 76 of the anchor element 70 function to grip the tapered surface 78 of the wedge member 68, thus transferring the force of the casing weight through the anchor and wedge of the casing hanger to the annular wellhead member 14. It should be borne in mind that any suitable casing hanger assembly, which also defines a stop surface for limiting downward movement of the seal bushing element 56 will permit proper metal seal setting function of the seal cartridge of the present invention.

According to the principles of the present invention a tubular sleeve element 80 is disposed in assembly with the seal bushing element 56 and is provided with its internally threaded lower extremity received within an internally threaded annular recess 82 of the seal bushing. The sleeve element 80 cooperates with a recess 84 defined by the upper portion of the seal bushing element so as to form an upwardly facing annular slot 86. The annular slot 86 is adapted to receive a lower tubular extension 88 of the lower section 46 of the energizing mandrel in movable relation therein. The lower tubular extension 88 is also machined to define an annular radially inwardly facing groove 90 which cooperates with an annular radially outwardly facing annular groove 92 of the seal bushing element 56 to thus define an annular receptacle 93 having a circular retainer wire element or ring 94 loosely disposed therein. The retainer ring element 94 serves as a restraining element which prevents disassembly of the energizing mandrel and the seal bushing or seal ring stop during seal cartridge retrieval and in the event the energizing mandrel is subjected to conditions of well pressure below the elastomer seals 52 and 54. Yet, the cooperative relationship of the retainer ring element 94 and the length of the annular receptacle 93 will permit relative upward and downward movement of the lower tubular extension 88 of the energizing mandrel with respect to the seal bushing element when setting of metal seals is appropriate. To prevent relative movement of the energizing mandrel and seal bushing as the packoff assembly is being run through well devices such as a blowout preventor, for example, a shear pin 96 is extended through aligned shear pin bores of the tubular extension 88 and the seal bushing 56. As shown in FIG. 3, the shear pin has been sheared to thus permit downward movement of the energizing mandrel relative to the seal bushing 56. This downward movement of the energizing mandrel is necessary to accomplish mechanically induced setting of the metal seal rings with respect to the wellhead and the well casing responsive to pressure induced movement of the energizing mandrel.

To accomplish metal-to-metal sealing between the packoff assembly and the opposed cylindrical surfaces 20 and 26 of the wellhead and casing respectively, a pair of metal seal rings 98 and 100 are provided which are carried to the sealing positions thereof by the assembled energizing mandrel and seal bushing. These seal rings are composed of a metal material having less hardness as compared with the hardness of the wellhead and the well casing. For example, the seal rings 98 and 100 may be composed of 316 stainless steel or any other suitable metal material capable of sealing with the smooth sealing surface of the wellhead and the rough outer peripheral surface of the well casing 22. The energizing member 46 is provided with a seal actuating section 103 of double tapered configuration which defines outer and inner tapered seal actuating surfaces 102 and 104, i.e., cam surfaces, which engage corresponding tapered surfaces 106 and 108 of the seal rings. While the shear pin 96 remains in its non-sheared condition, the tubular extension 88 of the energizing mandrel is disposed in substantially fixed relation with the seal bushing element 56 so that the tapered or cam surfaces of the energizing element and metal seal rings remain inactive. However, as soon as the shear pin 96 is sheared by downward force on the energizing mandrel by pressure above the elastomeric seals 52 and 54, the energizing mandrel will move downwardly relative to the seal bushing or stop element 56. During this activity the metal seal rings 98 and 100 will be supported against downward movement by the seal bushing or stop member 56. With the metal seal rings so supported, the double tapered cam surfaces 102 and 104 of the seal actuating section 103 of the energizing mandrel will interact with the correspondingly tapered cam surfaces 106 and 108 of the metal seal rings, thereby subjecting the outer metal seal ring to radial expansion and subjecting the inner seal ring 100 to radial contraction so that respective sealing thereof to the wellhead and well casing will be accomplished. The downward force of the energizing mandrel, which is translated to the metal seal rings via the tapered cam surfaces is resisted by annular seal support shoulders 110 and 112 that are defined respectively by the seal bushing element and sleeve 80. Thus, downward movement of the energizing element relative to the metal seal rings 98 and 100 causes radial expansion of the metal seal ring 98 and radial contraction of the metal seal ring 100. This activity causes upper and lower toothed sections of each of the seal rings such as shown at 112 and 114 to essentially bite into and establish intimate sealing engagement with the respective internal sealing surface 20 and external surface 26 of the wellhead and well casing respectively. The double tapered cam surfaces of the seal actuating section 103 of the energizing member, interacting with the correspondingly tapered cam surfaces of the metal seal rings cause the downward force being applied by the energizing element to be enhanced significantly, so that the resulting force of the seal rings on the wellhead housing surface 20 and the casing surface 26 will be sufficiently high to effectuate efficient metal-to-metal sealing. Moreover, the soft metal of the seal rings permits the seal rings to be deformed to a sufficient extent to accommodate the rough outer surface of the well casing and establish an efficient metal-to-metal seal therewith. The energizing mandrel, responsive to well pressure above the elastomer seals 52 and 54 applies a preload force to the metal seal rings, which deflects the seal rings to accomplish efficient sealing. When the energizing mandrel is locked by positioning of the locking ring 32 as shown in FIGS. 1 and 2, the preload force of the energizing mandrel is retained even under conditions where the well pressure above the elastomer seals has been depleted. Only when the locking mandrel is engaged and moved upwardly by a pulling tool will the preload force of the energizing mandrel on the seal rings be relaxed.

Operation

Running of the Seal Cartridge

The seal cartridge of the present invention is run within a well by any suitable conventional running tool, not shown, which is typically releasably connected to the locking mandrel 28 or the energizing mandrel of the seal cartridge. For the cartridge running operation, the locking mandrel 28 will be retained at its running or retracted position with respect to the energizing mandrel by the shear pin 41 or by any other suitable restraining and releasing mechanism. Also during running of the seal cartridge, the annular metal seal rings 98 and 100 will be in their respective relaxed condition because the shear pin 96 restrains relative movement between the energizing mandrel and the seal bushing element 56 until such time as the shear pin has become sheared. The seal cartridge is run into the well and is passed through various well equipment, such as the usual blowout preventer. When the upper end of the well casing 22 is reached, because of its dimension the seal cartridge will enter the annulus 18 between the inner seal surface 20 of the wellhead housing bore and the outer peripheral surface 26 of the well casing. Downward movement of the seal cartridge within the annulus 18 will be permitted until the lower end of the seal bushing 56 comes into contact with the upwardly facing end of the casing hanger assembly 66 and the metal seal rings 98 and 100 in supported contact with the support shoulders 110 and 112. At this point, the seal cartridge will have been properly positioned within the annulus 18 but its metal seal rings will not have been properly set. Since the elastomer seals will be in sealing relation with the wellhead and well casing, thus providing an elastomer bridging seal for the annulus, application of pressure within the wellhead above the elastomer seals will cause application of downward seal ring preloading force on the metal seals. However, it is desirable as such preloading pressure is being applied to lock the energizing mandrel with respect to the wellhead housing so that the preload force can be maintained after the preloading pressure has been depleted.

For such locking activity, the running tool will then apply a downward force to the locking mandrel 28, this downward force being sufficiently great to overcome the resistance of the shear pin 41, thus shearing the pin and permitting downward locking movement of the locking mandrel relative to the energizing mandrel 40. During its downward movement by the running tool, and enhanced by pressure induced actuation of the energizing mandrel, the locking mandrel applies a downward force to the energizing mandrel and causes the lock actuating element thereof to move the locking ring 32 into registry with the annular locking groove 34 and expand the locking ring so that its upwardly facing tapered shoulder 29 establishes intimate restraining engagement with the downwardly facing tapered shoulder 31 of the annular locking groove. In this position, the locking ring will retain the pre-load force cooperatively applied by the energizing mandrel and locking mandrel. It should be borne in mind that the preloading force for the metal seal rings may be applied solely by the energizing mandrel, so that the locking mandrel is only used to lock the energizing mandrel in its seal actuating position relative to the wellhead housing.

As the seal energizing cartridge is moved to its seal actuating position and locked with respect to the wellhead, the metal seal rings 98 and 100 will be actuated, i.e., preloaded for accomplishing the set and sealed conditions thereof with respect to the wellhead housing and well casing. During installation of the seal cartridge within the annulus 18, the upper and lower sets of elastomeric seals will have established sealing with respect to the inner sealing surface 20 of the wellhead housing and the outer peripheral surface of the well casing 22. Thus, the seal cartridge will have established an elastomeric bridging seal having the capability of restraining seal cartridge setting pressure though perhaps not being capable of restraining the well pressure for which the seal cartridge is designed. To set the metal seal rings with respect to the wellhead housing and the well casing a setting pressure is applied in the region between a hydraulic tool and the rams of the blowout preventer, thus applying the setting pressure to the annular pressure exposed region of the energizing mandrel 40 of the seal cartridge that is defined by engagement of the upper elastomeric seals 52 and 54 with the annular surfaces 20 and 26. This pressure induced downward force pushes the seal cartridge downwardly, pre-loading the seal cartridge and causing application of a shearing force to the shear pin 96. Shearing of the shear pin 96 permits downward movement of the energizing mandrel, while the seal bushing or stop element 56 is restrained by the casing hanger as mentioned above. Upon shearing of the shear pin 96 the downwardly projecting tubular extension 88 will move further into the annular slot or recess 84 and the double tapered seal actuating surfaces 102 and 104 will interact with the correspondingly tapered surfaces 106 and 108, thus applying resultant radial forces to the respective metal seal rings. The metal seal ring 98 is urged or moved radially outwardly so that the outward sealing geometry thereof is urged into metal-to-metal sealing engagement with the inner sealing surface 20 of the wellhead housing. The seal setting force applied to the metal seal ring 98 is sufficiently great to apply hoop stress to the metal seal ring so that it is expanded within the elastic limits of its metal material to accomplish metal-to-metal sealing with the surface 20. Simultaneously, the tapered seal actuating surface 104 applies a radial contracting force to the metal seal ring 100, causing it to be radially deformed, i.e., deflected such that the inner sealing geometry thereof is driven into metal-to-metal sealing engagement with the rough outer peripheral surface 26 of the well casing 24. This seal deforming force is sufficiently great to drive the tooth-like sealing regions 14 thereof into pressure restraining metal-to-metal sealing with the outer peripheral surface of the casing. The softer metal of the metal seal ring, as compared to the hardness of the casing, essentially displaces the metal thereof into the surface irregularities of the rough casing surface, so that an efficient pressure containing seal is established with the casing.

As the metal seal rings are being urged into metal-to-metal sealing with the respective surfaces 20 and 26, the double tapered camming section 103 of the energizing mandrel also causes the tapered seal actuating surfaces thereof to establish metal-to-metal sealing with the correspondingly tapered surfaces of the metal seal rings. The metal-to-metal contact of the double tapered camming section 103 with the metal seal rings also provides metal-to-metal sealing. The tapered seal actuating surfaces 102 and 104 may be provided with annular relief grooves such as shown at 105 to minimize the contact area and thus increase the sealing pressure between the correspondingly tapered surfaces. Thus, the resulting metal-to-metal seal is capable of adequately resisting high well pressure and maintaining efficient sealing.

After setting of the metal seals has occurred, the locking ring will retain the pre-load force that was induced during the seal setting operation. The locking ring, until its release, will be retained against releasing movement by the lock actuating element 30 as long as the locking mandrel remains at its locking position as shown in FIGS. 1 and 2. At its locking position, the locking mandrel maintains the locking ring within the annular locking groove so that the locking ring restrains the upwardly facing annular shoulder of the energizing mandrel and maintains all of the sealing surfaces of the cartridge in efficient seal maintaining relation.

Retrieval of the Seal Cartridge

When it is appropriate to remove the seal cartridge from the well, a conventional pulling tool, not shown, is run into the well and establishes pulling engagement with the locking mandrel 28. As the pulling tool moves the locking mandrel upwardly, the lock actuating element is essentially removed from its force transmitting engagement with the inner periphery of the locking ring 32. With the lock actuating element removed from its lock restraining position, the preload force acting on the tapered surface engagement of the locking ring and locking groove surfaces 29 and 31 will cause forcible contraction of the locking ring, thus returning the locking ring to its contracted or relaxed condition. During this activity the preload force on the metal seal rings will dissipate and the seal rings will return to their original configurations by virtue of the elastic memory or spring characteristics. This preload relaxing characteristic of the metal seal rings will break the metal-to-metal seals and prepare the seal cartridge for extraction from the annulus.

The spring characteristics of the material from which the metal locking ring is composed will also assist in returning the locking ring to its collapsed condition. When the upward force of the retrieval tool has unlocked the seal cartridge from the wellhead housing, the retrieval or pulling tool will apply an upward force to the energizing mandrel causing its upward movement in the annulus 18. During initial upward movement of the energizing mandrel the annular seal bushing will remain static until all lost motion is taken up by relative movement of the recesses 90 and 90 with respect to the retaining ring 94.

As the upward force on the energizing mandrel is continued the tubular extension will move upwardly within the slot 84 of the seal bushing element until the retainer ring 94 restrains such relative movement. Thereafter, upward movement of the energizing mandrel will be transferred through the retaining ring 94 to the structure of the annular seal bushing element 56, thus also moving the seal bushing element and fits elastomeric seals upwardly within the annulus 18. This upward movement of the seal cartridge by the pulling or retrieval tool will continue until the seal cartridge has been completely extracted from the annulus 18 and the retrieved through the well to the surface. The seal cartridge can then be readied for reinstallation simply by replacing the shear pins and, if the elastomer seals are worn or in any way defective, the elastomer seals may be replaced within the energizing mandrel and seal bushing.

Thus, the sealing system of the present invention is utilized to provide a metal-to-metal seal of the annulus between a rough casing and the wellhead seal bore. The seal cartridge is energized, with a predetermined pre-load, as pressure is applied between a hydraulic tool and the rams, consequently urging the energizing mandrel in a downward direction. The pre-load of the seal is controlled by the distance the energizing mandrel is allowed to move with respect to the seal bushing element 56. The pre-load in the seal cartridge is stored in the system as the packoff is locked in place. This pre-load is released only when the packoff mechanism is unlocked by appropriate upward movement of the lock actuator 30, permitting its actuating profile to release the locking dogs 32. Thereafter, the energizing mandrel and the seal bushing may be retrieved by simple upward movement, even though the shear pin 96 will have been sheared. The retaining wire or ring 94 will ensure that the seal bushing 56 remains in assembly with the energizing mandrel when the seal cartridge is retrieved from the well.

In view of the foregoing it is evident that the present invention is one well adapted to attain all of the objects and features hereinabove set forth, together with other objects and features which are inherent in the apparatus disclosed herein.

As will be readily apparent to those skilled in the art, the present invention may easily be produced in other specific forms without departing from its spirit or essential characteristics. The present embodiment is, therefore, to be considered as merely illustrative and not restrictive, the scope of the invention being indicated by the claims rather than the foregoing description, and all changes which come within the meaning and range of equivalence of the claims are therefore intended to be embraced therein.

We claim:

1. A mechanically energized annular packoff seal cartridge for metal-to-metal sealing with substantially concentrically arranged first and second tubular members disposed annularly spaced relation and defining an annulus therebetween, comprising:

a generally tubular pressure responsive seal energizing mandrel having inner and outer tapered seal actuating surfaces and having at least a portion thereof disposed for entry into said annulus;

inner and outer metal seal rings being maintained in relatively movable assembly with said generally tubular pressure responsive seal energizing mandrel and disposed for metal-to-metal sealing respectively with said first and second tubular members and being disposed for actuating contact by said inner and outer tapered seal actuating surfaces;

an annular seal bushing element adapted for entry into said annulus and defining a support for restraining linear movement of said inner and outer metal seal rings; and upon application of pressure induced force to said generally tubular pressure responsive seal energizing mandrel, said inner and outer tapered seal actuating surfaces urging said inner and outer metal seal rings in radially opposite directions and into metal-to-metal sealing relation respectively with said first and second tubular members for packoff sealing of said annulus.

2. The mechanically energized annular packoff seal cartridge of claim 1, comprising:

said inner and outer tapered seal actuating surfaces each being of substantially frusto-conical configuration and being disposed in downwardly converging relation; and said inner and outer metal seal rings each having frusto-conical surfaces thereon being disposed for camming engagement by said inner and outer tapered seal actuating surfaces for oppositely directed radial movement of said inner and outer metal seal rings responsive to linear downward movement of said seal energizing mandrel.

3. The mechanically energized annular packoff seal cartridge of claim 1 wherein said second tubular member having a rough outer peripheral surface with which packoff sealing is desired, comprising:

said annular outer metal seal ring being composed of a metal material having less hardness as compared with the metal hardness of said second tubular member and having the capability of accommodating surface irregularities of said rough outer peripheral surface and establishing a metal-to-metal seal therewith.

4. The mechanically energized annular packoff seal cartridge of claim 3, comprising:

said inner and outer metal seal rings being composed of 316 stainless steel or a metal of substantially equivalent hardness and being of less hardness as compared with the hardness of said first and second tubular members.

5. The mechanically energized annular packoff seal cartridge of claim 3, comprising:

said outer metal seal ring being composed of 316 stainless steel or a metal of substantially equivalent hardness and being of less hardness as compared with the hardness of said second tubular member.

6. The mechanically energized annular packoff seal cartridge of claim 1, comprising:

a locking groove being defined by said first tubular member;

a locking mandrel being carried by said seal energizing mandrel; and at least one locking member being disposed in actuated relation with said locking mandrel and being movable by said locking mandrel into said locking groove for establishing releasable and moveable assembly of said seal energizing mandrel to said first tubular member, said locking member maintaining said seal energizing mandrel in a position preloading said inner and outer metal seal rings.

7. The mechanically energized annular packoff seal cartridge of claim 6, comprising:

a force responsive release device releasably securing said locking mandrel in substantially fixed relation with said seal energizing mandrel and releasing said locking mandrel from said energizing mandrel responsive to predetermined force thereon and permitting movement of said locking member into said locking groove by said locking mandrel and permitting pressure responsive movement of said seal energizing mandrel relative to said first and second tubular members.

8. The mechanically energized annular packoff seal cartridge of claim 1, comprising:

a pair of inner and outer elastomeric sealing elements being supported in oppositely facing radial directions by said seal energizing mandrel and disposed for sealing engagement respectively with said substantially concentrically arranged first and second tubular members and defining an elastomer bridge seal therewith; and said inner and outer elastomeric sealing elements and said seal energizing mandrel representing an annular pressure responsive cross-section.

9. The mechanically energized annular packoff seal cartridge of claim 1, comprising:

an annular seal bushing defining an annular upwardly facing receptacle and having elastomeric seals for respective sealing engagement with said first and second tubular members;

a tubular member extending from said generally tubular pressure responsive seal energizing mandrel and being movably received within said annular upwardly facing receptacle;

a retainer element retaining said tubular member of said seal energizing mandrel within said annular upwardly facing receptacle and thus retaining said seal energizing mandrel and said seal bushing in relatively moveable assembly.

10. The mechanically energized annular packoff seal cartridge of claim 9, comprising:

a force responsive release member securing said tubular member in substantially immovable relation with said annular seal bushing and releasing said tubular member for relative movement with said annular seal bushing upon application of a predetermined downwardly directed release force by said seal energizing mandrel.

11. A mechanically energized annular packoff seal cartridge for metal-to-metal sealing with substantially concentrically arranged first and second tubular members disposed in annularly spaced relation and defining an annulus therebetween, said mechanically energized annular packoff seal cartridge comprising:

a generally tubular pressure responsive energizing mandrel having inner and outer elastomer seals for respective sealing engagement with said first and second tubular members and having inner and outer tapered seal actuating surfaces disposed in downwardly converging relation, at least a portion of said generally tubular pressure responsive seal energizing mandrel being disposed for entry into said annulus;

inner and outer annular metal seal rings being maintained in assembly with said generally tubular pressure responsive seal energizing mandrel and disposed for metal-to-metal sealing respectively with said first and second tubular members and being disposed for actuating contact by said inner and outer tapered seal actuating surfaces; and a seal bushing element defining at least one support for said inner and outer annular metal seal rings to limit downward movement thereof relative to said first and second tubular members, upon application of pressure induced force to said generally tubular pressure responsive seal energizing mandrel and with said inner and outer annular metal seal rings restrained by said seal bushing element, said inner and outer tapered seal actuating surfaces urging said inner and outer annular metal seal rings in radially opposite directions and into metal-to-metal sealing relation respectively with said first and second tubular members for metal-to-metal sealing of said annulus.

12. The mechanically energized annular packoff seal cartridge of claim 11, wherein said second tubular member having a rough outer peripheral surface with which packoff scaling is desired, comprising:

said annular outer annular metal seal ring being composed of a metal material having less hardness as compared with the metal hardness of said second tubular member and having the capability of accommodating surface irregularities of said rough outer peripheral surface and establishing a metal-to-metal seal therewith.

13. The mechanically energized annular packoff seal cartridge of claim 11, wherein said first tubular member defining a smooth inner peripheral sealing surface and second tubular member having a rough outer peripheral surface with which packoff sealing is desired, comprising:

said inner and outer metal seal rings having less hardness as compared with said first and second tubular members.

14. The mechanically energized annular packoff seal cartridge of claim 11, comprising:

said seal bushing element defining an upwardly facing annular receptacle and having annular support members for supporting engagement with said inner and outer metal seal rings;

a connection member extending downwardly from said generally tubular pressure responsive seal energizing mandrel and being received within said upwardly facing annular receptacle; and a retainer element retaining said generally tubular pressure responsive seal energizing mandrel and said seal bushing in relatively moveable assembly.

15. The mechanically energized annular packoff seal cartridge of claim 11, comprising:

a force responsive release device releasably securing said seal bushing element in substantially fixed relation with said generally tubular pressure responsive seal energizing mandrel and releasing said seal bushing element from said generally tubular pressure responsive seal energizing mandrel responsive to predetermined force thereon and permitting movement of at least a portion of said generally tubular pressure responsive seal energizing mandrel within said annular receptacle and permitting pressure responsive movement of said generally tubular pressure responsive seal energizing mandrel relative to said first and second tubular members for mechanically energizing said inner and outer metal seal rings for sealing with said inner and outer tubular members.

16. The mechanically energized annular packoff seal cartridge of claim 11, comprising:

at least one annular elastomeric sealing member being provided on said seal bushing element and establishing sealing of said seal bushing element with said first and second tubular members.

17. A mechanically energized annular packoff seal cartridge for metal-to-metal sealing with substantially concentrically arranged first and second tubular members disposed in annularly spaced relation and defining an annulus therebetween, said mechanically energized annular packoff seal cartridge comprising:

a generally tubular pressure responsive energizing mandrel having inner and outer elastomer seals for respective sealing engagement with said first and second tubular members and having inner and outer tapered seal actuating surfaces disposed in downwardly converging relation, at least a portion of said generally tubular pressure responsive energizing mandrel being disposed for entry into said annulus;

inner and outer metal seal rings being maintained in assembly with said generally tubular pressure responsive energizing mandrel and disposed for metal-to-metal sealing respectively with said first and second tubular members and being disposed for actuating contact by said inner and outer tapered seal actuating surfaces;

a locking groove being defined by said first tubular member;

a locking mandrel being carried by said energizing mandrel;

at least one locking member being disposed for locking actuation by said locking mandrel and being movable by said locking mandrel into said locking groove for releasably locking said energizing mandrel to said first tubular member;

a seal stop element defining at least one support for said inner and outer annular metal seal rings to limit downward movement thereof relative to said first and second tubular members, upon application of pressure induced force to said generally tubular pressure responsive energizing mandrel and with said inner and outer annular metal seal rings restrained against downward movement by said seal stop element, said inner and outer tapered seal actuating surfaces urging said inner and outer metal seal rings in radially opposite directions for metal-to-metal sealing relation respectively with said first and second tubular members for metal-to-metal sealing of said annulus and establishing preload force on said inner and outer annular metal seal rings, said locking member releasably locking said energizing mandrel against upward movement and maintaining said preload force on said inner and outer annular metal seal rings.

18. The mechanically energized annular packoff seal cartridge of claim 17 wherein said second tubular element having a rough outer peripheral surface with which packoff sealing is desired, said seal cartridge comprising:

said outer metal seal ring being composed of a metal material having less hardness as compared with the metal hardness of said second tubular member and having the capability of accommodating surface irregularities of said rough outer peripheral surface and establishing a metal-to-metal seal therewith.

19. The mechanically energized annular packoff seal cartridge of claim 17, comprising:

a force responsive release device releasably securing said locking mandrel in substantially fixed relation with said seal energizing mandrel and releasing said locking mandrel from said seal energizing mandrel responsive to predetermined force thereon and permitting movement of said locking member into said locking groove by said locking mandrel and permitting pressure responsive movement of said seal energizing mandrel relative to said first and second tubular members.

20. The mechanically energized annular packoff seal cartridge of claim 17, comprising:

elastomer seals being provided on said energizing mandrel and on said seal stop element and establishing elastomer sealing thereof with said first and second tubular members.

* * * * *

UNITED STATES PATENT AND TRADEMARK OFFICE

CERTIFICATE OF CORRECTION

PATENT NO. : 6,510,895 B1
DATED : January 28, 2003
INVENTOR(S) : Koleilat et al.

It is certified that error appears in the above-identified patent and that said Letters Patent is hereby corrected as shown below:

Column 8,
Line 43, delete “14”, insert -- 114 --

Column 9,
Line 45, delete “fits”, insert -- its --
Line 50, delete “the”, first occurrence Signed and Sealed this First Day of July, 2003

JAMES E. ROGAN
*Director of the United States Patent and Trademark Office*